US008956116B2

(12) United States Patent
Ahmad et al.

(10) Patent No.: US 8,956,116 B2
(45) Date of Patent: Feb. 17, 2015

(54) COOLING OF A GAS TURBINE COMPONENT DESIGNED AS A ROTOR DISK OR TURBINE BLADE

(75) Inventors: Fathi Ahmad, Kaarst (DE); Harald Hoell, Wächtersbach (DE); Karsten Kolk, Mülheim a.d. Ruhr (DE); Harald Nimptsch, Essen (DE); Werner Setz, Rösrath (DE)

(73) Assignee: Siemens Aktiengesellschaft, München (DE)

( * ) Notice: Subject to any disclaimer, the term of this patent is extended or adjusted under 35 U.S.C. 154(b) by 486 days.

(21) Appl. No.: 13/392,927

(22) PCT Filed: Sep. 2, 2010

(86) PCT No.: PCT/EP2010/062880
§ 371 (c)(1),
(2), (4) Date: Apr. 25, 2012

(87) PCT Pub. No.: WO2011/026903
PCT Pub. Date: Mar. 10, 2011

(65) Prior Publication Data

US 2012/0207615 A1 Aug. 16, 2012

(30) Foreign Application Priority Data

Sep. 2, 2009 (EP) ..... 09011282

(51) Int. Cl.
*F01D 5/14* (2006.01)
*F01D 5/08* (2006.01)
*F01D 5/18* (2006.01)

(52) U.S. Cl.
CPC ..... *F01D 5/081* (2013.01); *F01D 5/085* (2013.01); *F01D 5/187* (2013.01); *F05D 2260/94* (2013.01); *F05D 2260/941* (2013.01); *F05D 2250/52* (2013.01)
USPC ..... 416/97 R; 416/231 R; 415/116

(58) Field of Classification Search
USPC ..... 416/97 A, 96 A
See application file for complete search history.

(56) References Cited

U.S. PATENT DOCUMENTS

| | | | |
|---|---|---|---|
| 2,010,022 | A | 8/1935 | Holzwarth |
| 2,085,788 | A | 12/1936 | Biedermann |
| 4,344,738 | A | 8/1982 | Breunig et al. |
| 5,152,657 | A | 10/1992 | Junod et al. |
| 5,779,437 | A | 7/1998 | Abdel-Messeh et al. |
| 6,176,646 | B1 | 1/2001 | Finn et al. |

(Continued)

FOREIGN PATENT DOCUMENTS

| | | | |
|---|---|---|---|
| CN | 1643236 | A | 7/2005 |
| EP | 0227580 | A2 | 1/1987 |

(Continued)

OTHER PUBLICATIONS

US 5,853,110, 12/1998, Abuaf (withdrawn).

*Primary Examiner* — Edward Look
*Assistant Examiner* — Michael Sehn

(57) ABSTRACT

A gas turbine component for example a turbine blade or a rotor disk is provided. In order to extend the service life of the corresponding component by reducing the thermally or mechanically induced stress concentration in the direct surroundings of a duct opening onto a surface, at least one groove-like recess is provided near the effective zone of the opening.

11 Claims, 3 Drawing Sheets

(56) References Cited

U.S. PATENT DOCUMENTS

| | | | | |
|---|---|---|---|---|
| 6,183,202 | B1 * | 2/2001 | Ganshaw | 416/219 R |
| 6,237,344 | B1 * | 5/2001 | Lee | 60/754 |
| 7,160,084 | B2 * | 1/2007 | Ahmad | 416/231 B |
| 2004/0197191 | A1 | 10/2004 | Cunha et al. | |
| 2008/0298972 | A1 * | 12/2008 | Le Hong | 416/219 R |

FOREIGN PATENT DOCUMENTS

| | | | |
|---|---|---|---|
| EP | 0924384 | A2 | 6/1999 |
| EP | 1128024 | A2 | 8/2001 |
| EP | 1262631 | A2 | 12/2002 |
| GB | 2438861 | A | 12/2007 |
| JP | 53049609 | | 5/1978 |
| JP | 56168327 | | 12/1981 |
| JP | S6025740 | A | 2/1985 |
| JP | 1110809 | | 4/1989 |
| JP | 1113406 | | 5/1989 |
| JP | 2154919 | | 6/1990 |
| JP | 10299408 | | 11/1998 |
| JP | 2000329493 | A | 11/2000 |
| JP | 2000339106 | A | 12/2000 |
| JP | 2001234703 | A | 8/2001 |
| JP | 2002205161 | A | 7/2002 |
| JP | 2002206161 | A | 7/2002 |
| JP | 2003524138 | A | 8/2003 |
| JP | 2004308658 | A | 11/2004 |
| JP | 2005307981 | A | 11/2005 |
| RU | 2323343 | C2 | 4/2008 |
| WO | WO 0156703 | A1 | 8/2001 |
| WO | WO 03062607 | A1 | 7/2003 |

* cited by examiner

COOLING OF A GAS TURBINE COMPONENT DESIGNED AS A ROTOR DISK OR TURBINE BLADE

CROSS REFERENCE TO RELATED APPLICATIONS

This application is the US National Stage of International Application No. PCT/EP2010/062880, filed Sep. 2, 2010 and claims the benefit thereof. The International Application claims the benefits of European Patent Office application No. 09011282.2 EP filed Sep. 2, 2009. All of the applications are incorporated by reference herein in their entirety.

FIELD OF INVENTION

The invention refers to a gas turbine component having at least one passage opening onto a smooth, i.e. unstructured, surface.

BACKGROUND OF INVENTION

A large number of generic-type gas turbine components are known from the prior art. A turbine blade, for example, with cooling air openings which open onto the surface of the turbine blade around which hot gas flows, as film-cooling holes, for example, may be understood by the gas turbine component which is referred to in the introduction. Also, a rotor disk for a gas turbine, in which mostly radially extending bores are arranged for the passage of air, is to be understood by a gas turbine component within the meaning of the present patent application. Also, turbine stator blade carriers, which are known from the prior art, have passages for the passage of cooling air, used later for cooling, which open onto its surface.

Common to all the said gas turbine components is that the material which directly surrounds the passage is subjected to specific loads. In the case of turbine stator blades and rotor blades, particularly thermal and mechanical loads occur. Rotor disks are also particularly mechanically loaded on account of the centrifugal forces which occur. Cyclic loads can also occur. The loads lead to stresses which on account of the presence of the passages—which in most cases are created by bores—are further increased close to the surface in the immediate surroundings of the passage (stress concentrations). Regardless of the origin of the load, the increases may be impermissibly large, which limits the service life of the corresponding components.

Therefore, cracks can develop in the components referred to in the introduction, starting from the mouth region of the passages, which cracks have to be monitored and lead to exchange of the components when a critical crack length is exceeded.

It can also be that calculations carried out during the construction of the components show that, on account of an incipient crack-stress cycle number which is excessively low, the desired calculated service life is not achieved.

Thus known, for example, are turbine blades which with the aid of passages which extend obliquely through their component wall direct cooling air to their outer side, forming a protective film there. In order to achieve a particularly good protective effect, an expansion recess for the cooling air is provided at the hot gas-side passage end according to GB 2 438 861 A, for example. A similar measure for improving the cooling effect is known from U.S. Pat. No. 5,653,110 A1, according to which the passage end opens onto a surface which is corrugated on the hot gas side. Also, in the case of the known developments, there is the above-described risk that cracks can develop due to thermomechanical stresses in the mouth region.

SUMMARY OF INVENTION

The object of the invention is therefore the provision of a reliable gas turbine component with extended service life.

The object upon which the invention is based is achieved by a gas turbine component according to the features of the claims.

The invention provides that provision is made in the virtually smooth surface close to the mouth of the passage for at least one groove-like recess which is separated from the mouth by means of a dividing wall and which, with regard to a stress concentration induced in the material of the gas turbine component as a result of the passage, effectively reduces this stress concentration compared with the stress concentration without a groove-like recess. By the provision of grooves according to the invention, which constitute blind-ending recesses, the stress concentration in the direct surroundings of the passage section opening onto the surface is reduced, compared with a design without such grooves. By reducing the stress concentration, material fatigue on account of cyclic load changes, and therefore the risk of development of fatigue cracks, is reduced. Should cracks actually occur, their propagation is correspondingly slowed down. Consequently, the gas turbine component according to the invention has the desired service life extension.

Moreover, it is provided that the dividing wall has a minimum wall thickness and the passage has a mouth diameter and that a ratio of minimum wall thickness to diameter lies within the range of between 0.05 and 3, preferably between 0.05 and 2. As a result, on the one hand it is ensured that the distance between the mouth and the relieving groove-like recess is not excessively large, which would impair the effectiveness. On the other hand, a satisfactory integrity of the dividing wall is ensured.

Advantageous developments are disclosed in the dependent claims.

According to one advantageous development, the gas turbine component is designed as a rotor disk for a gas turbine. The rotor disk is preferably designed as a turbine disk and has a number of retaining grooves, distributed along the periphery, for rotor blades, the walls of which retaining grooves have a surface, and wherein the at least one groove-like recess is arranged in each case at least close to one of the passages which open onto the surface concerned.

According to an alternative development, the gas turbine component is designed as a turbine blade having a number of passages which open onto a surface around which hot gas can flow, of which at least one of the passages has the at least one groove-like recess, for reducing the stress concentration, close to its mouth in the surface.

The arrangement according to the invention is therefore ideal on the one hand for rotor disks in which bores for the passage of cooling air are provided. In this case, they can be turbine disks, on the outer periphery of which turbine rotor blades are inserted in corresponding retaining grooves, or they can also be compressor disks which are inserted in the compressor-side section of the rotor for the extraction of compressor air.

On the other hand, the invention is particularly advantageously used in turbine blades in which mostly cylindrically formed cooling air discharge openings open onto a surface around which hot gas can flow. Since particularly the cooling passage outlets which are arranged in a leading edge of the blade airfoil of a turbine blade are subjected to the highest thermal loads, it is advisable to protect especially these against the development of cracks with the aid of the groove-like recess according to the invention and to slow down the propagation of cracks which have already developed.

The at least one passage for the conducting of cooling medium is expediently formed as a bore.

An advantageous development of the rotor disk has two recesses which, in a cross-sectional view taken perpendicularly to the rotational axis of the rotor disk, are arranged on both sides of the mouth. In other words, the retaining grooves, in which the rotor blades of the gas turbine are inserted, have walls which for one thing comprise a groove-base surface and for another thing comprise two flank surfaces which lie opposite each other, are at least partially corrugated, and extend to the outer edge of the rotor disk, wherein one of the recesses is arranged in each case in the transition from the groove-base surface to the respective flank surface.

The recesses in this case can be discretionary in respect to their contour. Preferably, the contour is mainly rectangular but with rounded corners between the sidewalls. In the same way, the transition of the sidewalls of the recess to the base surface is rounded. Both serve for reducing and avoiding notch stresses.

According to an alternative development, the groove-like recess can be formed as an endless groove which encompasses the mouth of the passage concerned. More preferably, the endless groove is arranged in a circular manner and concentrically to the mouth of the passage concerned. In particular, two or possibly more grooves are arranged concentrically around the mouth of the passage concerned, wherein these can also have different groove depths. If the groove-like recess is formed as an endless groove, this can especially preferably be used in the rotor disk and in the turbine blade. Instead of a circular endless groove, this can naturally also be elliptical.

All in all, using the invention a gas turbine component with an extended service life is disclosed. The service life extension is achieved based on a stress reduction in those regions of the gas turbine component which, on account of a passage arranged there, could have an impermissibly high stress concentration for this region. As a result of the stress reduction, moreover, the operating risk to a gas turbine equipped with the component is minimized since cracks now develop in the component less frequently.

BRIEF DESCRIPTION OF THE DRAWINGS

The further explanation of the invention is carried out based on the exemplary embodiments depicted in the drawing.

In detail, in the drawing.

Like parts are provided with the same designations in all the figures.

DETAILED DESCRIPTION OF INVENTION

Figure 1:
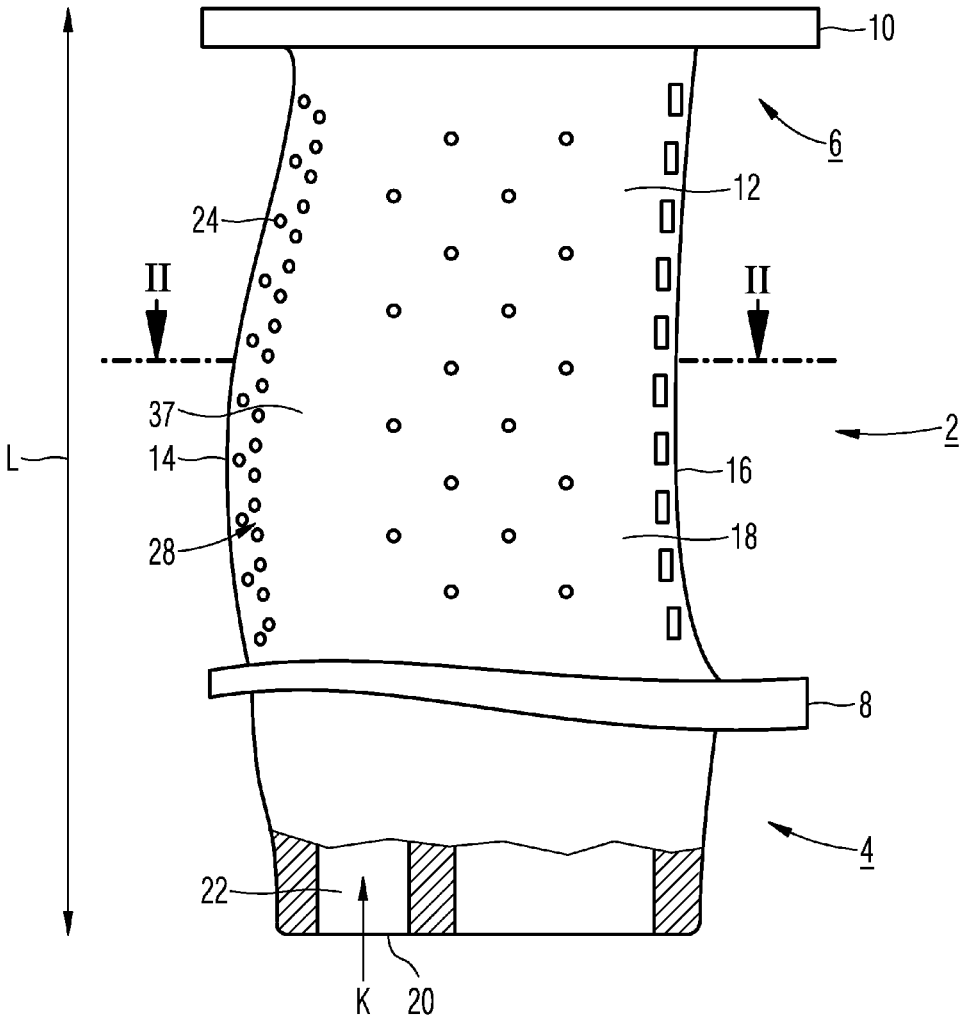
FIG. 1 shows a side view of a turbine blade.

A turbine blade 2 according to FIG. 1 is designed as a stator blade for a gas turbine which is not additionally shown here. It comprises a root section 4 and a tip section 6 with associated platforms 8, 10, and a blade airfoil 12 in between these extending in the longitudinal direction L. The aerodynamically curved blade airfoil 12 has a leading edge 14 and a trailing edge 16, also extending essentially in the longitudinal direction L, with sidewalls 18 lying in between. The turbine blade 2 is fixed on the inner casing of the turbine via the root section 4, wherein the associated platform 8 forms a wall element which delimits the flow path of the hot gas in the gas turbine. The tip-side platform 10 lying opposite the turbine shaft forms a further limit for the flowing hot gas. The turbine blade 2 could alternatively also be designed as a rotor blade which in a similar way is fastened on a rotor disk of the turbine shaft via a root-side platform 8 which is also referred to as a blade root.

Via a number of inlet openings 20, which are arranged on the lower end of the root section 4, cooling medium K is introduced into the blade interior. Also known are concepts in which the feed of cooling medium K is carried out via the tip-side platform 10. The cooling medium K is usually cooling air. After the cooling medium K has flowed through a cooling-medium passage 22, or a plurality of cooling-medium passages, which adjoin the inlet openings 20, in the interior of the turbine blade 2, it discharges at a number of outlet openings 24 in the region of the blade airfoil 12 which communicate with the cooling medium passages 22 and are also referred to as film-cooling holes. Different sections of the blade airfoil 12 make quite different demands in this case upon the arrangement and design of the film-cooling holes with regard to the varied thermal load and mechanical load and also with regard to the respective space requirements in the blade interior.

Particularly the comparatively sharply curved leading edge region 28, which directly adjoins the leading edge of the blade airfoil, requires an efficient cooling on account of a relatively high load.

Figure 2:
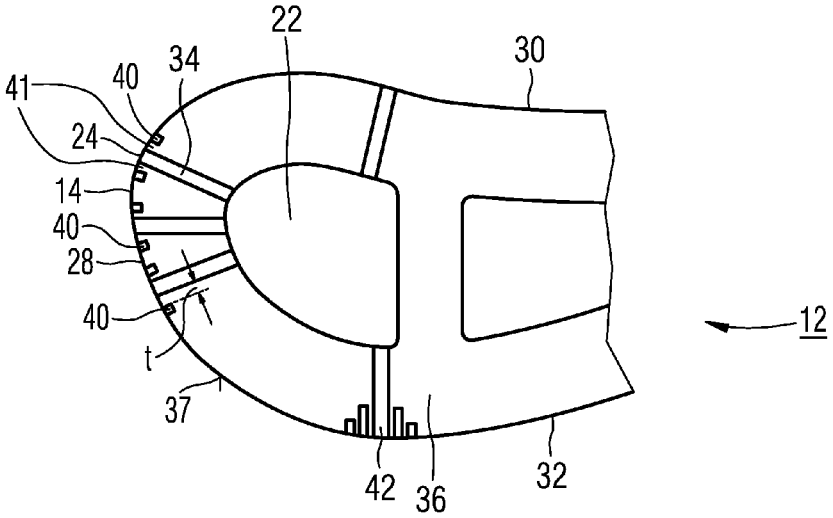
FIG. 2 shows the cross section through the blade airfoil of the turbine blade from FIG. 1.

FIG. 2 shows the front region of the profiled blade airfoil 12 in cross section according to the line of intersection II-II from FIG. 1, with the leading edge region 28 comprising the leading edge 14 and adjoining which are a pressure side 30 and a suction side 32. Outlet passages 34 of smaller cross section branch from a cooling-medium passage 22 which extends essentially in the longitudinal direction L of the turbine blade 2 and is at a distance from the leading edge 14, which outlet passages penetrate the blade wall 36 and in the leading edge region 28 open into outlet openings 24 or film-cooling holes. As a result of cooling medium K flowing through the outlet passages 34, convective cooling of the adjacent regions of the blade wall is achieved. The effect of the film cooling on the surface 37 of the blade airfoil 12, caused by the cooling air discharging from the outlet openings 24, contributes towards the convective cooling of the blade interior. In this case, an air cushion or a protective film is virtually formed on the surface 37 of the blade wall 36 as a result of the cooling air which flows at comparatively low speed along it, the air cushion or protective film preventing a direct contact with the blade surface 37 by the hot gas which has a high speed.

In the prior art, radially propagating cracks used to occur particularly at the hot gas-side end of the outlet passages 34, and in the worst case impaired the integrity of the blade airfoil 12 and therefore of the entire turbine blade 2, shortening the service life. In order to avoid such defects, at least one groove-like recess 40 (FIG. 2), which for reasons of clarity is not shown in FIG. 1, is provided at least in outlet passages 34 opening onto the leading edge 14 for reducing the stress concentration in the material which directly surrounds the mouth of the outlet passage 34.

Particularly in those outlet passages 34 which open onto a surface 37 around which hot gas can flow, the groove-like recesses 40 according to the invention are formed in this case as endless grooves which are arranged concentrically to the outlet passage 34 which opens onto the surface 37. A dividing wall 41, which has a minimum wall thickness t, remains between the groove-like recess 40 and the outlet passage 34. For achieving the desired stress reduction, the minimum wall thickness t should be no thinner than 0.05 times a diameter D of the outlet passage 34 and be no thicker than 3 times the said diameter D. For example, the minimum wall thickness t is 0.5 times, 1 times, or even 1.5 times the diameter D. According to a variant of the invention, two concentric, endless grooves can also be arranged around an outlet passage 34 in each case, which, for example, is exemplarily shown at the passage designated 42.

Figure 3:
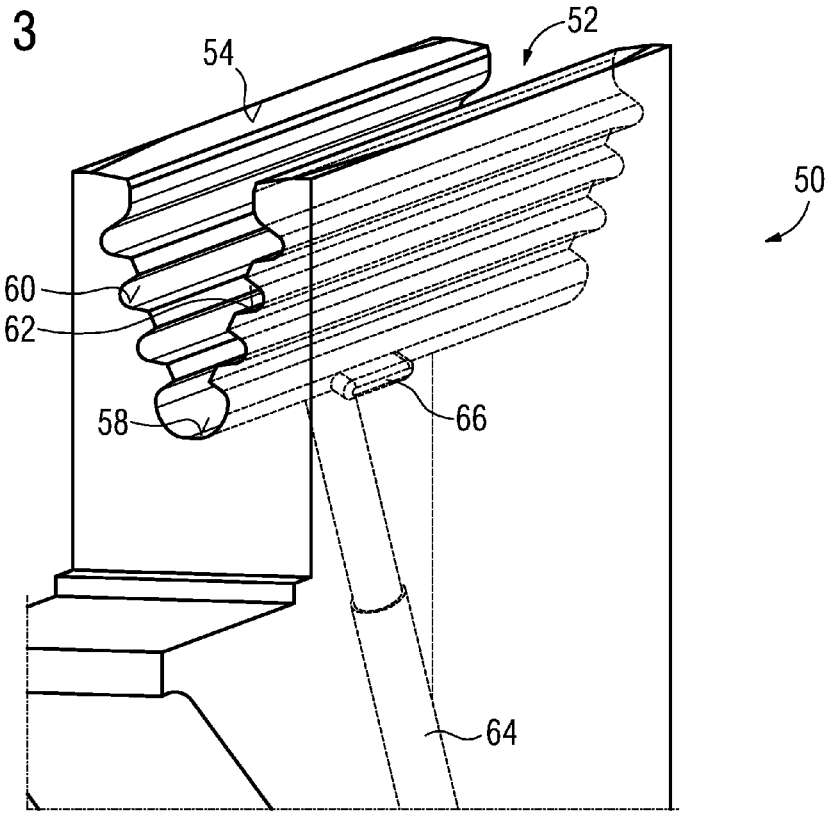
FIG. 3 shows a detail of a perspective view of a rotor disk of a gas turbine.
Figure 4:
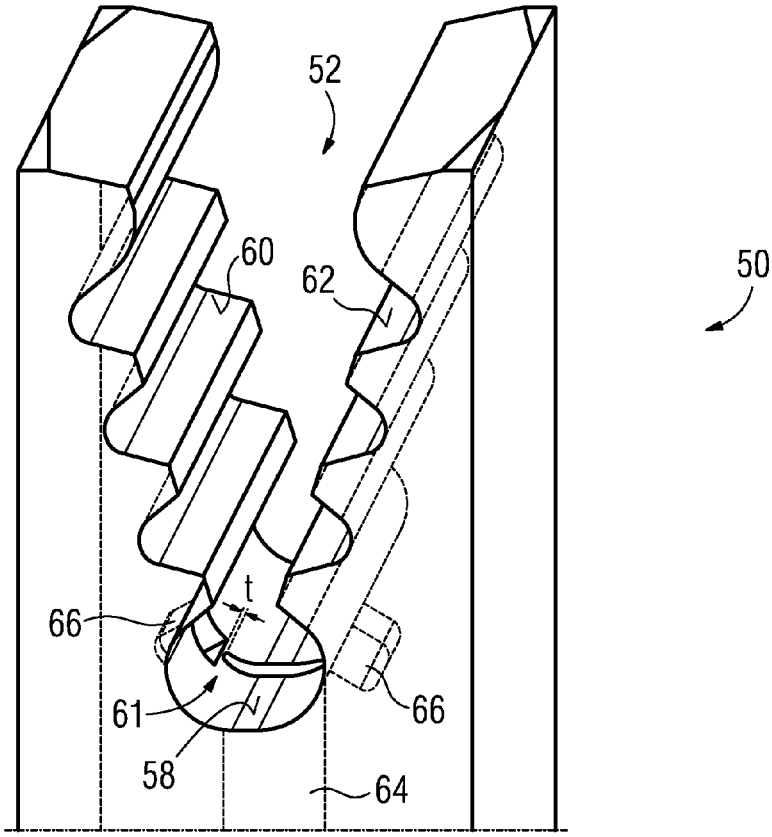
FIG. 4 shows the detail according to FIG. 3 from another perspective.

FIG. 3 and FIG. 4 schematically show a detail of a perspective view of a rotor disk 50 in each case as a further gas turbine component. The rotor disk 50, as a turbine disk, is equipped according to a known manner with a number of retaining grooves 52 which are distributed at uniform distances on the generated surface 54 of the rotor disk 50 along the periphery. The retaining groove 52 is open radially towards the outside and additionally has side openings in each case which are provided in the end faces of the rotor disk 50. The end-face contour—seen in cross section—of the retaining groove 52 corresponds in this case essentially to a fir-tree shape, wherein other shapes are also known and can be used. Rotor blades of the turbine of a gas turbine can be inserted in the retaining grooves 52, wherein the corresponding rotor blades have blade roots which are formed in conformance with the contour of the retaining groove 52.

Each retaining groove 52 therefore has walls with surfaces. The surface can be divided into a groove base-side surface 58 and into two lateral surfaces 60, 62 which are arranged on the flanks of the retaining groove and laterally adjoin the groove base surface 58 in a transitionless manner. Since as a rule the turbine blades which are inserted in the retaining grooves 52 have to be cooled during operation in the gas turbine, cooling air is fed to these via the blade root. For the feed of cooling air, provision is made in the rotor disk 50 for a passage 64 which opens onto the groove base surface 58 of the retaining groove 52. The rotor blades, which are inserted in the retaining grooves 52, have inlet openings for cooling air on their surface lying opposite the groove base surface 58 in order to allow the cooling air, which is fed via the passage 64, to enter the rotor blades. The cooling of the blade airfoil and/or of the platform which is part of the rotor blade is carried out in the rotor blade in a manner which is known but irrelevant to the invention.

For reducing the stress concentration in the direct surroundings of the mouth of the passage 64, a groove-like recess 66 is arranged in each case in the two transitions between the groove base 58 and the lateral surfaces 60, 62. The recesses 66 in this case are positioned so that in a cross sectional view taken perpendicularly to the rotational axis of the rotor disk 50 these are arranged on both sides of the mouth. The two recesses 66 therefore lie on both sides of the mouth as seen in the circumferential direction of the rotor disk.

As is particularly evident from FIG. 4, there is a dividing wall 61 between the groove-like recess 66 and the mouth of the passage 66. This dividing wall also has a minimum wall thickness t which preferably lies between 0.05 times and 2 times the diameter D of the mouth of the passage 64. For example, the minimum wall thickness t is 1 times the diameter D.

As a result of this, the stress concentration, which is increased on account of the presence of the passage 64, is reduced in the region of the material close to the surface, which reduces material fatigue due to cyclic load changes during operation of the gas turbine and therefore reduces the risk of development of fatigue cracks.

All in all, the invention discloses a gas turbine component 2, 50, for example a turbine blade 2 or a rotor disk 50 for a gas turbine, in which at least one groove-like recess 40, 66 is provided in the effective zone of the mouth for extending the service life of the corresponding component 2, 50 by reducing the thermally or mechanically induced stress concentration in the direct surroundings of a passage 34, 64 which opens onto a surface 37, 58.

The invention claimed is:

1. A gas turbine component, comprising:

a passage, opening onto an unstructured surface, for conducting a cooling medium; and a groove-like recess, wherein in the surface, close to the mouth of the passage, provision is made for the groove-like recess which is separated from the mouth by means of a dividing wall and which with regard to a stress concentration which is induced as a result of the passage effectively reduces this compared with the stress concentration without a groove-like recess, and wherein the dividing wall has a minimum wall thickness and the passage has a mouth diameter, and a ratio of minimum wall thickness to diameter lies within the range of between 0.05 and 3.

2. The component as claimed in claim 1, wherein the range is between 0.05 and 2.

3. The component as claimed in claim 1, wherein the gas turbine component is designed as a rotor disk for a gas turbine, including a plurality of retaining grooves, distributed along the periphery, to accommodate a rotor blade, wherein the walls of the retaining grooves each include the surface, and wherein the groove-like recess is arranged in each case close to a passage which opens onto the respective surface.

4. The component as claimed in claim 3, wherein the passage is formed as a bore.

5. The component as claimed in claim 3, wherein provision is made for two groove-like recesses which, in a cross-sectional view taken perpendicularly to the rotational axis of the rotor disk, are arranged on both sides of the mouth.

6. The component as claimed in claim 3, wherein the groove-like recess is formed as an endless groove which encompasses the mouth of the passage concerned.

7. The component as claimed in claim 6, wherein the endless groove is arranged in a circular manner and concentrically to the mouth of the passage concerned.

8. The component as claimed in claim 3, wherein each passage opens onto a groove base of the retaining groove concerned.

9. The component as claimed in claim 1, wherein the gas turbine component is designed as a turbine blade including a plurality of passages which open onto a surface around which hot gas can flow, of which the passage includes the groove-like recess, for reducing the stress concentration, close to its mouth in the surface.

10. The component as claimed in claim 9, wherein the recess is formed as an endless groove which encompasses the mouth of the passage concerned.

11. The component as claimed in claim 10, wherein the endless groove is arranged in a circular manner and concentrically to the mouth of the passage concerned.

* * * * *